US006918210B1

(12) United States Patent
Smiley

(10) Patent No.: US 6,918,210 B1
(45) Date of Patent: Jul. 19, 2005

(54) CABLE DRIVEN SLIDING DOOR ACTUATOR

(76) Inventor: Edward D. Smiley, 3907 Pine St., Wilmington, DE (US) 19808

( * ) Notice: Subject to any disclaimer, the term of this patent is extended or adjusted under 35 U.S.C. 154(b) by 38 days.

(21) Appl. No.: 10/369,458

(22) Filed: Feb. 20, 2003

(51) Int. Cl.[7] ..... E05F 11/54
(52) U.S. Cl. ..... 49/360; 49/347
(58) Field of Search ..... 49/332, 347, 352, 49/360, 324, 357, 121, 404, 117; 52/207, 52/204.51

(56) References Cited

U.S. PATENT DOCUMENTS

| | | | | | |
|---|---|---|---|---|---|
| 620,006 | A * | 2/1899 | Williams | 49/360 |
| 873,175 | A * | 12/1907 | Sayre | 49/347 |
| 1,315,308 | A * | 9/1919 | Homan | 49/332 |
| 1,605,728 | A * | 11/1926 | Hiltz | 49/123 |
| 1,743,249 | A * | 1/1930 | Shelida | 49/360 |
| 2,054,898 | A * | 9/1936 | Edwards | 49/273 |
| 2,597,539 | A * | 5/1952 | Smart | 52/204.51 |
| 2,746,745 | A * | 5/1956 | Damon | 49/35 |
| 3,137,491 | A * | 6/1964 | Coenen | 49/300 |
| 3,403,474 | A * | 10/1968 | Spasoff | 49/360 |
| 4,050,189 | A * | 9/1977 | Peterson | 49/26 |
| 4,083,149 | A * | 4/1978 | Hickman et al. | 49/147 |
| 4,738,052 | A * | 4/1988 | Yoshida | 49/31 |
| 4,835,920 | A * | 6/1989 | Posner et al. | 52/204.51 |
| 5,422,552 | A * | 6/1995 | Parisi | 318/466 |
| 5,711,112 | A * | 1/1998 | Barten et al. | 49/118 |
| 5,784,831 | A * | 7/1998 | Licking | 49/141 |
| 6,658,793 | B2 * | 12/2003 | Perron | 49/123 |
| 6,691,465 | B1 * | 2/2004 | Stephan | 49/404 |
| 2002/0053169 | A1 * | 5/2002 | Menuzzo | 49/360 |
| 2002/0157317 | A1 * | 10/2002 | Valencia et al. | 49/360 |

* cited by examiner

*Primary Examiner*—Gregory J. Strimbu

(57) ABSTRACT

A sliding door actuator having a small electric motor and cable system is added to a standard sliding glass door for a residence. As the motor may be controlled by a remote, an individual could simply press a button to open the door. This convenience would be especially helpful to older individuals and those having limited mobility. The sliding door actuator having a winch spool drivingly connected to the drive motor. A drive cable is spoolably connected to the winch spool. The drive cable is connected to a sliding door. A return spring is connected to the drive cable for biasing the sliding door. An exit sensor is electrically connected to the drive motor to selectively actuate the sliding door.

1 Claim, 3 Drawing Sheets

CABLE DRIVEN SLIDING DOOR ACTUATOR

BACKGROUND OF THE INVENTION

1. Field of the Invention

The present invention relates to a sliding door actuator for use in connection with sliding doors. The sliding door actuator has particular utility in connection with actuators for sliding doors that have a drive belt and a return spring located within the stud space.

2. Description of the Prior Art

Sliding door actuators are desirable opening sliding doors for the elderly, handicapped or someone seeking additional convenience by the assistance of a powered device to open the sliding door.

The use of sliding doors is known in the prior art. For example, U.S. Pat. No. 5,656,898 to Kalina discloses a sliding door apparatus that includes a chain driven assembly, a reversible motor for moving the chain and a sliding door driver which converts the chain motion to door movement. A remote control device can also be used to operate the sliding door remotely, especially if users are elderly or handicapped individuals. However, the Kalina '898 patent does not provide a remote control slider connectable to an existing sliding patio door, wherein a drive belt is positioned within the stud space and has a spring biased return.

Similarly, U.S. Pat. No. 5,422,552 to Parisi discloses an automated actuator for sliding panels that is fabricated in kit form and adapted to be assembled and disassembled for use with sliding doors, windows or other similar panels. The actuator includes a support column which is adjustable to be braced at the existing door jamb at either side of the door frame to move the panel. Mounting of the actuator does not require the surrounding frame or wall structure to be structurally altered. Circuitry for the actuator ceases the sliding movement of the door when the door meets resistance, such as by a child or animal in the path of the door, and re-tests for the resistance to determine whether the door should continue along the intended path. However, the Parisi '552 patent does not provide a remote control slider connectable to an existing sliding patio door, wherein a drive belt is positioned within the stud space and has a spring biased return.

Lastly, U.S. Pat. No. 4,541,202 to Dockery discloses a sliding door operator and lock that comprises a tubular housing adapted to receive first and second elongated bars in a spaced apart and parallel arrangement. Both bars include a gear-toothed rack engaged by a single motor driven gear. An end of one bar is secured to the door and an end of the other bar is secured to a wall structure. A bracket secured to the door includes registering apertures adapted to mate with a bore in the end of one of the bars so that the bar can be detachably locked to the door by a locking pin. The other bar also includes a bore adapted to mate with the aperture in a channel bracket secured to the stationary wall structure to receive a removable locking pin therethrough. In addition, the operator includes a locking mechanism for locking the bars in a fixed position with respect to each other. However, the Dockery '202 patent does not provide a remote control slider connectable to an existing sliding patio door, wherein a drive belt is positioned within the stud space and has a spring biased return.

While the above-described devices fulfill their respective, particular objectives and requirements, the aforementioned patents do not describe a sliding door actuator that allows actuators for sliding doors that have a drive belt and a return spring located within the stud space. The Kalina '898, Parisi '552 and Dockery '202 patents make no provision for a remote control slider connectable to an existing sliding patio door, wherein a drive belt is positioned within the stud space and has a spring biased return.

Therefore, a need exists for a new and improved sliding door actuator which can be used for actuators for sliding doors that have a drive belt and a return spring located within the stud space. In this regard, the present invention substantially fulfills this need. In this respect, the sliding door actuator according to the present invention substantially departs from the conventional concepts and designs of the prior art, and in doing so provides an apparatus primarily developed for the purpose of actuators for sliding doors that have a drive belt and a return spring located within the stud space.

SUMMARY OF THE INVENTION

In view of the foregoing disadvantages inherent in the known types of sliding doors now present in the prior art, the present invention provides an improved sliding door actuator, and overcomes the above-mentioned disadvantages and drawbacks of the prior art. As such, the general purpose of the present invention, which will be described subsequently in greater detail, is to provide a new and improved sliding door actuator and method which has all the advantages of the prior art mentioned heretofore and many novel features that result in a sliding door actuator which is not anticipated, rendered obvious, suggested, or even implied by the prior art, either alone or in any combination thereof.

To attain this, the present invention essentially comprises a winch spool drivingly connected to the drive motor. A drive cable is spoolably connected to the winch spool. The drive cable is connected to a sliding door. A return spring is connected to the drive cable for biasing the sliding door. An exit sensor is electrically connected to the drive motor to selectively actuate the sliding door.

There has thus been outlined, rather broadly, the more important features of the invention in order that the detailed description thereof that follows may be better understood and in order that the present contribution to the art may be better appreciated.

The invention may also include a control panel, a wireless remote control, a motor access vent and a pulley. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved sliding door actuator that has all of the advantages of the prior art sliding doors and none of the disadvantages.

It is another object of the present invention to provide a new and improved sliding door actuator that may be easily and efficiently manufactured and marketed.

An even further object of the present invention is to provide a new and improved sliding door actuator that has a low cost of manufacture with regard to both materials and labor, and which accordingly is then susceptible of low prices of sale to the consuming public, thereby making such sliding door actuator economically available to the buying public.

Still another object of the present invention is to provide a new sliding door actuator that provides in the apparatuses and methods of the prior art some of the advantages thereof, while simultaneously overcoming some of the disadvantages normally associated therewith. Lastly, it is an object of the present invention is to provide a sliding door actuator for actuators for sliding doors that have a drive belt and a return spring located within the stud space.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
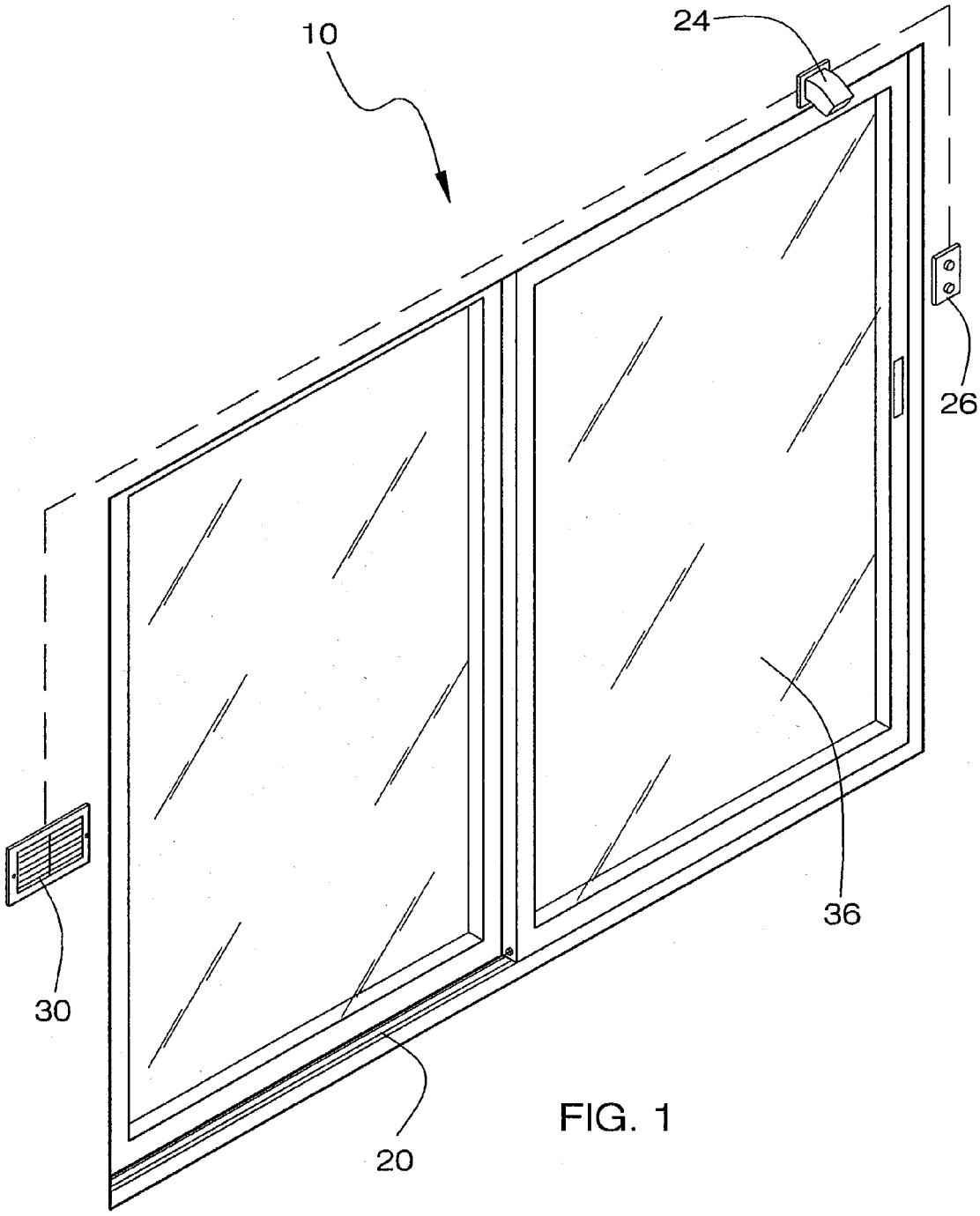
FIG. 1 is a front perspective view of the preferred embodiment of the sliding door actuator constructed in accordance with the principles of the present invention.

Referring now to the drawings, and particularly to FIGS. 1–4, a preferred embodiment of the sliding door actuator of the present invention is shown and generally designated by the reference numeral 10.

In FIG. 1, a new and improved sliding door actuator 10 of the present invention for actuators for sliding doors that have a drive belt and a return spring located within the stud space is illustrated and will be described. A lower drive cable 20 is connected to a sliding door 36. An exit sensor 24 is electrically connected to a drive motor 12 (shown in FIG. 2) to selectively actuate the sliding door 36. A control panel 26 is electrically connected to the drive motor 12 for selectively actuating the drive motor 12. The control panel 26 is capable of receiving wireless control signals. A motor access vent 30 is disposed on the wall directly adjacent to the drive motor 12.

Figure 2:
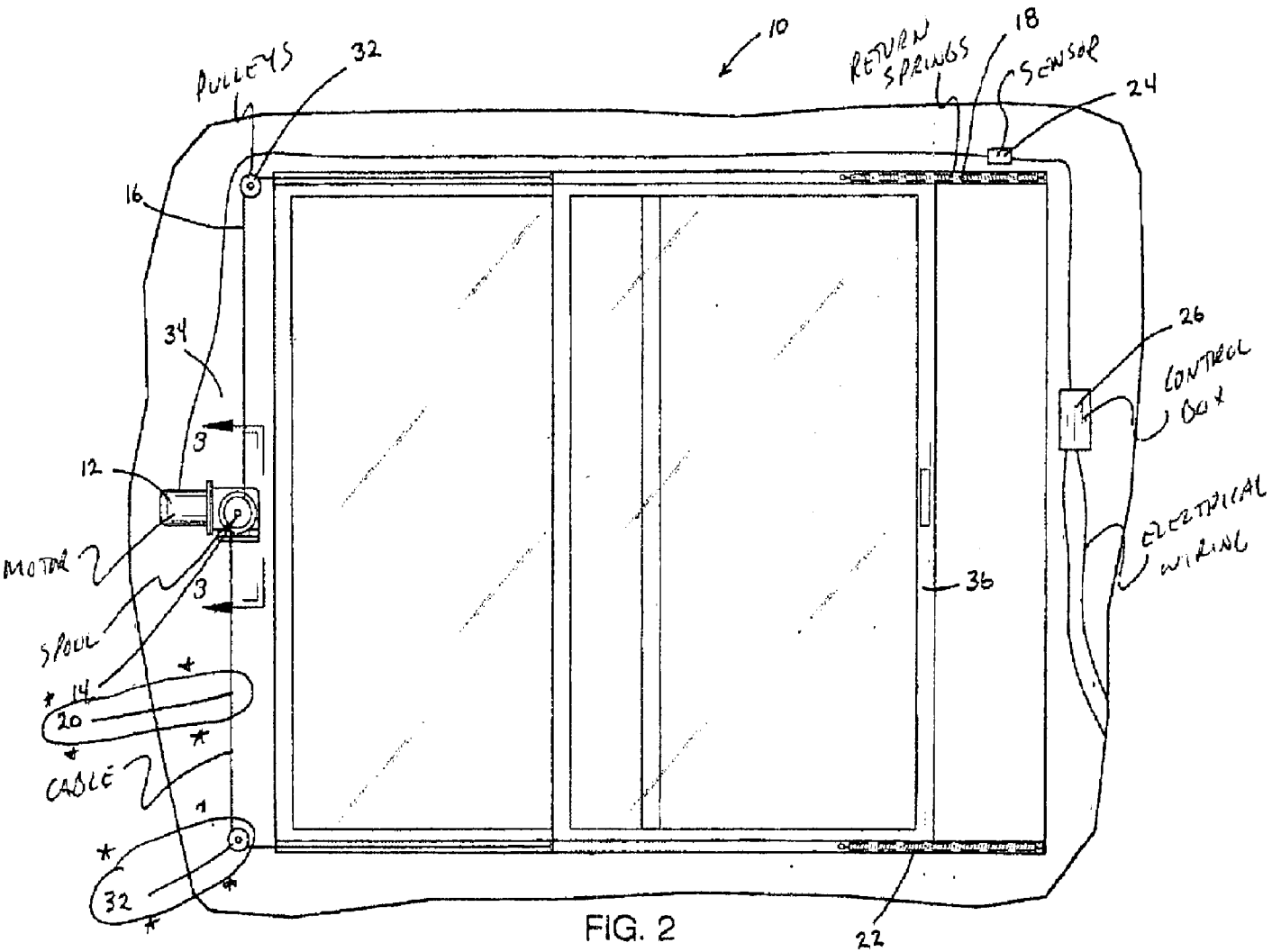
FIG. 2 is a front side view of the sliding door actuator of the present invention.

In FIG. 2, the sliding door actuator 10 is illustrated and will be described. More particularly, the sliding door actuator 10 has the drive motor 12 that is disposed within a stud space 34 adjacent to the sliding door 36. A winch spool 14 is drivingly connected to the drive motor 12. The winch spool 14 is disposed within the stud space 34 adjacent to the sliding door 36. An upper drive cable 16 is spoolably connected to the winch spool 14. The upper drive cable 16 is connected to the sliding door 36. An upper return spring 18 is connected to the sliding door 36 for biasing the sliding door 36. The lower drive cable 20 spoolably is connected to the winch spool 14. The lower drive cable 20 is connected to the sliding door 36. A lower return spring 22 is connected to the sliding door 36 for biasing the sliding door 36. The exit sensor 24 is electrically connected to the drive motor 12 to selectively actuate the sliding door 36. The control panel 26 is electrically connected to the drive motor 12 for selectively actuating the drive motor 12. The control panel 26 is capable of receiving wireless control signals. The motor access vent 30 is disposed on the wall directly adjacent to the drive motor 12. At least one pulley 32 is disposed within the stud space 34 adjacent to the sliding door 36. The upper drive cable 16 is rotatably connected to the pulley 32. The lower drive cable 20 is rotatably connected to the pulley 32.

Figure 3:
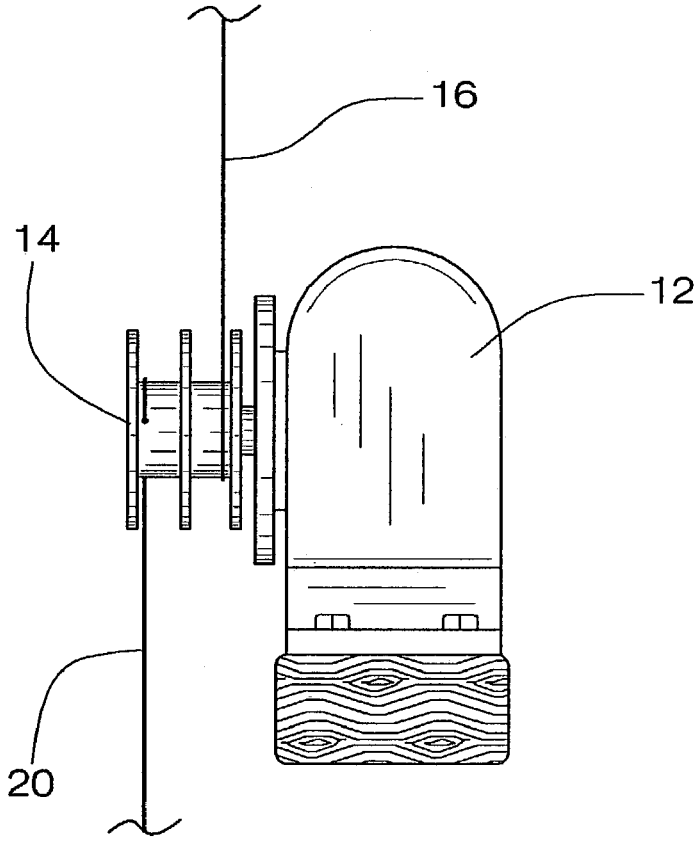
FIG. 3 is a section 3—3 view of FIG. 2 of the sliding door actuator of the present invention.

In FIG. 3, the sliding door actuator 10 is illustrated and will be described. More particularly, the sliding door actuator 10 has the drive motor 12. The winch spool 14 is drivingly connected to the drive motor 12. The upper drive cable 16 is spoolably connected to the winch spool 14. The lower drive cable 20 spoolably is connected to the winch spool 14. The lower drive cable 20 is connected to the sliding door 36. The lower return spring 22 is connected to the sliding door 36 for biasing the sliding door 36.

Figure 4:
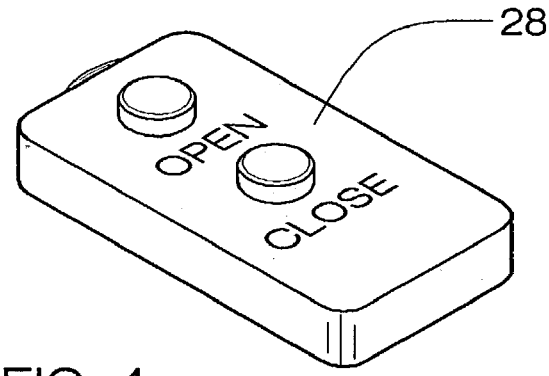
FIG. 4 is a top perspective view of the remote control of the sliding door actuator of the present invention.

In FIG. 4, the sliding door actuator 10 is illustrated and will be described. More particularly, a wireless remote control 28 is capable of sending wireless control signals.

In use, it can now be understood that the exit sensor 24, wireless remote control 28 or the control panel 26 may actuate the sliding door.

While a preferred embodiment of the sliding door actuator has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as plastic may be used instead of the aluminum described. And although actuators for sliding doors that have a drive belt and a return spring located within the stud space have been described, it should be appreciated that the sliding door actuator herein described is also suitable for sliding any type of panel on rollers.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sliding door actuator comprising:

a drive motor disposed within a wall of a building adjacent to a horizontally sliding door;

a winch spool drivingly connected to said drive motor, said winch spool disposed within said wall adjacent to said sliding door;

an upper drive cable spoolably connected to said winch spool, said upper drive cable connected to said sliding door adjacent an upper end of said door;

an upper return spring connected to said sliding door for biasing said sliding door;

a lower drive cable spoolably connected to said winch spool, said lower drive cable connected to said sliding door adjacent a lower end of said door;

a lower return spring connected to said sliding door for biasing said sliding door;

an exit sensor electrically connected to said drive motor to selectively actuate said sliding door;

a control panel electrically connected to said drive motor for selectively actuating said drive motor, wherein said control panel is capable of receiving a wireless control signal;

a wireless remote control capable of sending said wireless control signal;

a motor access vent disposed on said wall and directly adjacent to said drive motor; and two pulleys disposed within said wall adjacent to said sliding door one of said pulleys being disposed above said winch spool and the other of said pulleys being disposed below said winch spool, said upper drive cable and said lower drive cable rotatably connected to said pulleys.

* * * * *